US007426988B2

(12) United States Patent
Lopez Sanchez et al.

(10) Patent No.: US 7,426,988 B2
(45) Date of Patent: Sep. 23, 2008

(54) COIN RETURN PROCESS

(75) Inventors: Francisco Javier Lopez Sanchez, Navarra (ES); Alberto Lozano Cordovilla, Navarra (ES)

(73) Assignee: Azkoyen Medios de Pago S.A., Peralta Navarra (ES)

( * ) Notice: Subject to any disclaimer, the term of this patent is extended or adjusted under 35 U.S.C. 154(b) by 0 days.

(21) Appl. No.: 11/546,063

(22) Filed: Oct. 11, 2006

(65) Prior Publication Data

US 2007/0119683 A1 May 31, 2007

(30) Foreign Application Priority Data

Oct. 11, 2005 (ES) ..... 200502481

(51) Int. Cl.
*G07D 5/00* (2006.01)

(52) U.S. Cl. ..... 194/339

(58) Field of Classification Search ..... 194/339, 194/302; 73/163

See application file for complete search history.

(56) References Cited

U.S. PATENT DOCUMENTS 3,680,566 A 8/1972 Tanaka et al. ..... 133/3
5,885,151 A * 3/1999 Weston et al. ..... 453/17

FOREIGN PATENT DOCUMENTS

EP 0653085 5/1995
EP 0841645 5/1998
EP 1020818 7/2000
GB 2198274 6/1988
WO WO 99/06969 2/1999

OTHER PUBLICATIONS

European Search Report dated Feb. 19, 2007 based on the European Patent No. EP06380265.

* cited by examiner

*Primary Examiner*—Patrick Mackey
*Assistant Examiner*—Mark Beauchaine
(74) *Attorney, Agent, or Firm*—Ohlandt, Greeley, Ruggiero & Perle, L.L.P.

(57) ABSTRACT

The present invention relates to a coin return process applicable in coin returns in which at least two types i of coins of different values coexist in a single storage area. The process has the steps of:

obtaining a total value to be returned;

assigning different initial weights $Weight_i^0$ to each of the at least two types of coin, i<=2;

identifying the coin to be extracted or recovered by the return prior to its extraction or recovery; $Weights_i'$ is equal to a pre-established value, in which case the coin is extracted. Then, modifying, after the identification of, $Weight_i'$ the coin to be extracted or recovered by the return, the weight assigned to the identified coin, where the $Weight_i'$ being the modified weight; and, checking if the modified weight, $Weight_i'$ is equal to a pre-established value, in which case the coin is extracted.

6 Claims, 1 Drawing Sheet

COIN RETURN PROCESS

FIELD OF THE INVENTION

The present invention relates to a coin return process applicable to coin dispensers also referred to as hoppers or returns, particularly to the type incorporating a rotating extractor disk, capable of selectively extracting coins of different values.

BACKGROUND OF THE INVENTION

A coin return mechanism of this type is described for example in European patent application EP-1020818-A1, which is a return in which different denominations of coins can be mixed, having the particularity that the coins are identified in a step prior to the extraction, being able to decide if said coins should be extracted or not, according to their values.

This type of device has the advantage that a single return replaces two or more mechanisms of the single coin type with the savings of space and costs this implies. Nevertheless, they have the consistent drawback that, as one type of coins are limited in the storage area or hopper, the return times for this coin in particular can be excessively longer, even rendering the machine in which it is assembled out of service.

The same occurs if the distribution of coins inside the hopper is not homogenous, for example if the coins that are to be extracted are at a certain time accumulated far from the extractor disk, the same effect as that previously mentioned will occur.

Processes have been developed which try to reduce as much as possible the problems resulting from the limitation of coins in other types of return systems, for example those based on several vertical pipes, each of them storing a single type of coin. The publications of European patents EP-0653085-B1 an EP-0841645-A2 can be mentioned as documents of interest. These documents describe processes to optimize the number of coins of the return system to prevent as much as possible that the machine in which the coin system is installed is put out of service or working under the condition of exact change when any of the coins required for returning the excess credit introduced by the user have run out. One of the described processes consists of calculating the possible combinations of coins that add up to the credit to be returned and choosing the one using the lesser amount of coins, and another process further takes into consideration other conditions to change the initially chosen combination for another one which, even though it is not the optimal combination of the minimum number of coins, maintains the stock of a certain type of coin which would run out if the first process would be used. These types of processes can be carried out in the return systems in which there is only one type of coin per storage area, and the number of coins of each of the storage areas/returns, such that it is known beforehand the status of each of the returns before and after the return process, and the extraction of coins of which there are available units in the returns can furthermore be assured.

SUMMARY OF THE INVENTION

The invention relates to a coin return process according to claim 1. Preferred embodiments of the process are defined in the dependent claims.

The object of the present invention is a process applicable to discrimination-type coin return devices, i.e. in which at least two types of coins of different values coexist and which only dispense the coin being processed if it complies with certain characteristics that are associated to its value or denomination. The main difference between these return devices and those mentioned in the prior art is that since they involve a mixture of different types of coins, it is not known which will be the following type or types to reach the extractor disk, nor is the proportion of each of the existing types of coins known in all cases and much less the distribution or proportion of said coins inside the storage hopper, not being able to assure the extraction of a certain type of coin, even in the event that its presence in the storage area or hopper is known. All this makes the problem of the limitation of any type of coin at the time of extraction much more important, the solutions provided by the processes mentioned for the other type of change returns not being valid.

More specifically, the process of the invention is based on dynamically altering during the extraction process the weight or priority that is initially assigned to the different types of coins that can be extracted. Since the probability of finding a certain type of coin is not known, the weight is modified according to the coin that has just been identified regardless of whether or not this coin is extracted. The process described below tends to reserve coins that do not frequently reach the extractor system, whereas it tends to return a greater quantity of the types of coin that are more frequently detected all this provided that the total value of the return is complied with, even though the number of returned coins is not optimized.

One aspect of the present invention relates to a coin return process applicable in coin returns in which at least two types i of coins of different values coexist in a single storage area, comprising the steps of:

a) obtaining a total value to be returned;

b) assigning different initial weights $Weight_i^0$ to each of said at least two types of coin, i>=2;

c) identifying the coin to be extracted or recovered by said return prior to its extraction or recovery;

d) modifying after the identification of said coin to be extracted or recovered by the return, the weight assigned to said identified coin, $Weight_i^1$ being said modified weight; and, e) checking if said modified weight $Weight_i'$ is equal to a pre-established value, in which case said coin is extracted.

Preferably, said modification of the weight of a coin consists in decreasing by one unit the current weight of the coin, the value of which corresponds with the identified coin, provided that the weight of the identified coin is greater than said pre-established value.

Said initial weights $Weight_i^0$ can be calculated by dividing the value of the coin of greater value existing in the return by the value of each of the types i of coin of the return.

And said initial weights $Weight_i^0$ preferably have a maximum value that is less than or equal to the result of dividing the value of the coin of greater value by the value of the coin of less value. Said maximum weight will depend on the type of return used and on the type of coins that said return handles. Said initial weights $Weight_i^0$ can have a maximum value of 8.

According to a preferred embodiment of the process of the invention, when a coin is extracted, said value to be returned is also modified by subtracting the value of said extracted coin.

Likewise, according to a preferred embodiment of the process, steps c)-e) are repeated until the value to be returned is zero or less than the value of the coin of less value available in the return.

BRIEF DESCRIPTION OF THE DRAWINGS

A drawing which aids in better understanding the invention and which is expressly related to an embodiment of said invention, presented as a non-limiting example thereof, is described very briefly below.

DETAILED DESCRIPTION OF THE INVENTION

Figure 1:
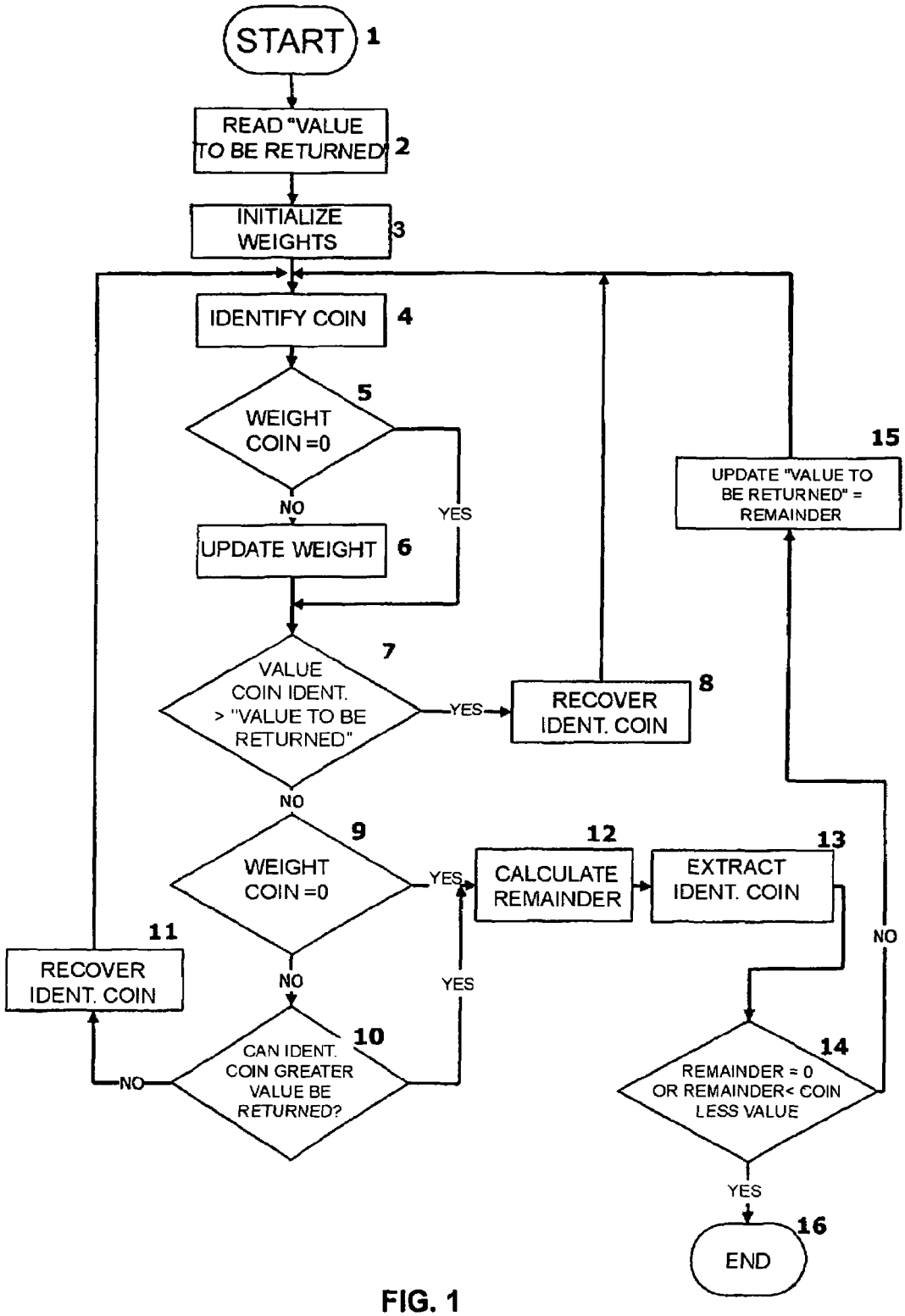
FIG. 1 shows a flow chart of the process de la invention.

The process shown in FIG. 1 is applicable in discrimination-type coin return devices in which at least two types of coins of different values coexist. In order to better understanding the operation of the process, assume that the coin return has four different types of coins, for example 2€, 1€, 0.50€ and 0.10€, in unknown quantity and proportions.

Once the process has begun (step 1), the return receives the information about the value that must be returned or extracted from its storage area (step 2). Then the weights or priorities (step 3) corresponding to the types of coins available are initialized, in the example, the four types of coins mentioned.

"Weight" or "priority" is understood to be a characteristic taken into consideration when making the decision to dispense (pay) or recover to the storage area the coin being processed which has been identified. The coin of less weight is the coin that is initially returned, whereas the coins of greater weight have less priority when being returned (extracted) or paid.

In the initial process of assigning the weights to the different coins (step 3), the criterion of dividing the value of the greater coin by the value of the different coins is applied. Therefore, in the present case the initial weight of the 2€ coin is Weight(2€)=2/2=1. In the same manner: Weight(1€)=2/1=2; Weight(0.50€)=2/0.5=4; Weight(0.10€)=2/0.10=20. To optimize the process, maximum weight of 8 is established, which has been experimentally proven to be the most suitable, such that even though the result of the operation is, as in the case of the 0.10€ coin of value 20, a maximum value of 8 is assigned; therefore in this example the initial weights of the coins are as follows: $\text{Weight}^0(2€)=1$; $\text{Weight}^0(1€)=2$; $\text{Weight}^0(0.50€)=4$; $\text{Weight}^0(0.10€)=8$. In any case, another value could be chosen for said maximum Weight, provided that it is less than the maximum value calculated according to the foregoing; i.e. maximum Weight<=Coin of greater value/Coin of less value.

Assume for example that the quantity to be returned read in step 2 is 1€. The return will have begun its coin extraction process and reaches the first coin which is identified by the measuring system incorporated in the return. Assume that the result of the identification (step 4) of said coin is 0.50€, the initial weight of which is $\text{Weight}^0(0.50€)=4$. According to the flow chart of FIG. 1, it is checked if the weight corresponding to said identified coin is different from 0 (step 5) and as Weight(0.50€)=4, the process of updating the weight of the identified coin is carried out, consisting of decreasing by one unit the current weight of said identified coin or coin being processed (step 6); in this case, the weight of the coin will thus be: Weight'(0.50€)=3. Then the next step is carried out in which the value of the coin being processed is compared with the value to be returned (step 7); as the value of the coin, 0.50€, is less than the amount to be returned, 1€, the next step is carried out in which the current weight of the coin being processed is evaluated (step 9); in the event that the identified coin was 2€, which is greater than the value to be returned, 1€, said coin would be recovered to the hopper or storage area (step 8). Going back to the previous example, as the weight is not zero, the next step which evaluates if the coin being processed is the coin of greater value that can be paid is carried out (step 10); in the present case, as the coin being processed 0.50€ is not the greatest one that could be returned, which would be 1€, the next step in which the coin is recovered to the hopper or storage area is carried out, i.e. it is rejected (step 11), and the next coin being processed is identified again (step 4).

In the event that the coin was 1€, the process would be directed to the extraction of the coin (step 13).

Going back to the previous example, the next coin being processed (step 4), which is assumed to be 0.50€, is again identified; it is checked that its weight is different from zero (step 5), in which case the weight of said coin is updated, decreasing it by one unit (step 6), i.e. Weight'(0.50€)=2, and steps 7 and 9 are repeated; as the coin has a weight that is different from zero, the coin is recovered and step 4 is again carried out. Again assume that the next coin is 0.50€, therefore its weight at the end of step 6 will be Weight'(0.50€)=1, but it still would not comply with the extraction condition in step 9 and would be recovered to the storage area, and step 4 would be carried out again; and again assuming that the next coin being processed was 0.50€, the weight of the coin would become Weight'(0.50€)=0, therefore the decision in step 9 would be positive and the "remainder" would be calculated as the value to be returned or paid minus the value of the coin being processed (step 12). In this example the calculated remainder would be 0.50€, the coin would be extracted (step 13), and as the remainder is not zero—which is checked in step 14, —the next coin being processed is identified again (step 4), proceeding in the same manner as that described, previously carrying out an update of the value to be returned (step 15) equaling it to the value of the remainder (calculated in step 12), until the remainder is zero or less than the value of the coin of less value available (step 14), in which case the process is concluded (step 16).

In a single payment once the weight for a type of coin reaches zero, its weight is not decreased by a unit because it is already at the minimum value (which has been established in this example at 0). Therefore, in the previous example once a 0.50€ coin has been extracted, the remainder is 0.50€ and the next coin being processed is then identified (step 4); assuming again that the next coin is 0.50€, as the weight of the 0.50€ coin is 0 (step 5), step 7 is directly carried out without updating the weight, and in the decision of step 9 the "remainder" is calculated (step 12), which will now be equal to 0, therefore said 0.50€ coin is then extracted (step 13); and as the remainder is zero (step 14), the process is concluded.

The described process is repeated from the beginning for each of the quantities requested to be extracted, i.e. the initial conditions are the same between consecutive payments, whereas the evolution of the weights or priorities of the coins can be different during the course of consecutive payments, even in the event that the quantities were identical.

As may be understood, the described process gives preference to the coins of greater value, but if they do not appear, another coin with less initial priority but which is more abundant may be the one that is returned in its place. Finally, the process is adapted dynamically to the irregularities of the stocks or of the distribution among the different types of coins, achieving that the payment maintains a balance between the amounts of the different coins, therefore preventing a certain type of coin from running out prematurely.

The invention claimed is:

1. A coin return process applicable in coin returns in which at least two types i of coins of different values coexist in a single storage area, comprising the steps of:

a) obtaining a total value to be returned;

b) assigning different initial weights $Weight_i^0$ to each of said at least two types of coin, i<=2;

c) identifying the coin to be extracted or recovered by said return prior to its extraction or recovery;

d) modifying, after the identification of said coin to be extracted or recovered by the return, the weight assigned to said identified coin, $Weight_i'$ being said modified weight;

e) checking if said modified weight $Weight_i'$ is equal to a pre-established value, and extracting said coin with said modified weight equal to said pre-established value;

f) after said coin is extracted, modifying said value to be returned, subtracting the value of said extracted coin; and g) repeating steps c)-e) until the value to be returned is zero or less than the value of the coin of less value available in the return.

2. The process according to claim 1, wherein said modification of the weight of a coin consists of decreasing by one unit the current weight of the coin the value of which corresponds to the identified coin.

3. The process according to claim 2, wherein said modification of the weight is carried out provided that the weight of the identified coin is greater than said pre-established value.

4. The process according to claim 1, wherein said initial weights $Weight_i^0$ are calculated by dividing the value of the coin of greatest value existing in the return by the value of each of the types i of coin of the return.

5. The process according to claim 1, wherein said initial weights $Weight_i^0$ have a maximum value which is less than or equal to the result of dividing the value of the coin of greatest value by the value of the coin of less value.

6. The process according to claim 1, wherein said initial weights $Weight_i^0$ have a maximum value of 8.

* * * * *